US006334770B1

(12) United States Patent
Giraud et al.

(10) Patent No.: US 6,334,770 B1
(45) Date of Patent: Jan. 1, 2002

(54) FLUID-FUEL FURNACE BURNER FOR IRON AND STEEL PRODUCTS

(75) Inventors: Patrick Giraud, Paris; Jean-Claude Montgermont, Lee Mee S/Seine; François Pahmer, Paris, all of (FR)

(73) Assignee: Stein Heurtey, Ris-Orangis (FR)

( * ) Notice: Subject to any disclaimer, the term of this patent is extended or adjusted under 35 U.S.C. 154(b) by 0 days.

(21) Appl. No.: 09/414,068

(22) Filed: Oct. 7, 1999

(30) Foreign Application Priority Data

Oct. 13, 1999 (FR) ..... 98 12824

(51) Int. Cl.[7] ..... F23D 14/56; F27B 9/36

(52) U.S. Cl. ..... 432/146; 432/147; 431/8; 431/9; 431/165; 431/350

(58) Field of Search ..... 432/19, 20, 121, 432/128, 146, 147, 171, 175; 431/8, 9, 115, 187, 181, 159, 165–166, 167, 350

(56) References Cited

U.S. PATENT DOCUMENTS 3,854,918 A * 12/1974 McKinstry ..... 432/146
4,397,451 A * 8/1983 Kinoshita et al. ..... 432/128
4,443,182 A * 4/1984 Wojcieson et al. ..... 431/181
4,469,314 A * 9/1984 Takeuchi et al. ..... 432/175
4,523,530 A * 6/1985 Kaminaka et al. ..... 110/264
4,717,334 A * 1/1988 Newman ..... 431/187
5,403,181 A * 4/1995 Tanaka et al. ..... 431/8
5,545,031 A * 8/1996 Joshi et al. ..... 431/8
5,554,022 A * 9/1996 Nabors, Jr. et al. ..... 431/10
5,743,723 A * 4/1998 Iatrides et al. ..... 431/8
5,906,485 A * 5/1999 Groff et al. ..... 432/146
5,919,039 A * 7/1999 Shaw et al. ..... 432/121

FOREIGN PATENT DOCUMENTS

JP 401054106 A * 3/1989 ..... 431/9

* cited by examiner

*Primary Examiner*—Gregory Wilson
(74) *Attorney, Agent, or Firm*—Connolly Bove Lodge & Hutz

(57) ABSTRACT

A fluid-fuel burner of the type producing a flame with axial development, which includes a combustion tile, having a broad shape, provided with an oxidizer and fuel injection orifices. These are approximately parallel to the major axis of symmetry of the tile, the internal shape of the latter as well as the orientation of the fuel and oxidizer injection orifices being chosen so as to create a difference in the distribution of the combustion products and of the recycled flue gases. A spread out flame is produced which ensures homogeneous distribution of the heat flux.

17 Claims, 4 Drawing Sheets

FLUID-FUEL FURNACE BURNER FOR IRON AND STEEL PRODUCTS

FIELD OF THE INVENTION

The present invention relates to a fluid-fuel burner, especially for furnaces for reheating iron and steel products. The aim of this invention is to design a burner with a spread-out flame, by virtue of which the distribution of the heat flux generated by the flame is improved so as to reduce the temperature heterogeneity induced in the products to be reheated.

BACKGROUND OF THE INVENTION

It is known that heat-treatment furnaces, especially reheat and soaking furnaces, are intended to raise products, especially slabs, blooms and the like, to the temperatures required, for example, for rolling or for the purpose of obtaining a given metallurgical structure.

It is also known that the quality of the treatment of a product, for example a rolling operation or a heat treatment, requires a precise and homogeneous temperature within the product, this temperature depending on the type of treatment desired or on the chemical composition of the product to be treated.

For example, in furnaces for reheating metallurgical products, the mean temperature level is obtained by passing the products through so-called heating zones which are characterized by a significant heat influx in a relatively short time, thereby generating considerable thermal heterogeneity in the reheated products. In order to obtain the temperature homogeneity required for their subsequent treatment, the products leaving the heating zones pass through an equalizing zone in which the heat influx is very small, thereby making it possible to equalize the temperatures within the products.

FIG. 1 of the drawings shows schematically, in side elevation and in vertical cross section, an illustrative example of a furnace of known type for reheating iron and steel products. This furnace is of the type with top and bottom heating.

As may be seen in FIG. 1, the products to be reheated, denoted by the reference 1, are supported and transported inside the furnace by a system of fixed beams 2 and walking beams 3, the walking beams 3 being moved by virtue of the combined actions of a translation frame 4 and of a lifting frame 5, giving the products 1 a back-step movement so as to convey them from the entry of the furnace to the exit. This is a system well known to those skilled in the art, which does not form part of the present invention and which is therefore unnecessary to describe in detail.

The furnace consists of a thermally insulated chamber 6, comprising respectively heating zones and equalizing zones, on which chamber top heating burners 7 and bottom heating burners 7' are placed, as well as equalizing burners 8 fitted into the roof of the furnace, as may be clearly seen in FIG. 1. In this illustrative example, the burners of the heating zones 7 and 7', which are fitted into the side walls of the furnace, are burners producing flames with axial development. The products to be treated are placed in a horizontal plane parallel to the axes of the burners. The latter may be fitted either in a plane lying above the plane of the bed of products (top burners 7) or in a plane lying below the plane of the bed of products (bottom burners 71). The height of the furnace chamber 6 is defined by the distance separating the plane of the products 1 from the sole of the furnace and by the distance separating the plane of the products from the roof of the furnace. This height depends on the characteristics and the dimensions of the flames from the burners 7 and 7' fitted into the side walls of the furnace.

FIG. 2 of the drawings shows schematically the distribution of the heat flux generated by the burners 7, 7' producing flames with axial development. In this Figure, the reference B denotes a burner, P the plane of the bed of products and I the image of the transmitted heat flux. It may be seen that the heat flux exhibits heterogeneities in the vertical planes perpendicular and parallel to the flame axis. These heterogeneities are caused by the progressive development of the combustion at the root of the flame or by the presence of hot zones in this flame, these being characteristic of this type of known burner.

In this illustrative example, the furnace also includes burners 8 fitted into the roof of the furnace in the equalizing zones of the latter. These are burners producing low-axial-momentum, high-swirl flames. The heat flux transmitted to the products to be reheated is constant, over a certain diameter, in a plane perpendicular to the axis of the burner 8 and parallel to the bed of products 1. These burners generate limited thermal heterogeneities in these products, however the area for homogeneous radiative exchange created by each burner is limited to a small unit area, thereby requiring a large number of burners such as 8 to be installed in order to ensure homogeneous reheating of the entire surface of the products. FIG. 3 shows schematically the burners 8 fitted into the furnace roof. In this figure, the reference Z denotes the main heating zone of each burner 8 on the furnace roof, Pv denotes the plane of the furnace roof and Ip denotes the image of the transmitted heat flux on the plane of the bed of products.

Finally, the bottom burners 7', which are fitted below the plane of the products 1, cannot be replaced with burners producing low-axial-momentum, high-swirl flames since it is impossible for them to be fitted into the sole of the furnace because of the presence of the equipment for supporting the products and because of the droppings of part of the oxides which form on the surface of these products during reheating. The bottom burners such as 7' of the equalizing zones can therefore only be burners producing flames with axial development, despite the heat-flux distribution shortcomings inherent in this type of burner.

As clearly follows from the above, achieving good temperature homogeneity of the reheated products in a furnace for reheating metallurgical products or in a heat-treatment furnace is limited by the current technology of burners of the type producing axisymmetric flames with axial development, or good temperature homogeneity is possible only partially by the complex and expensive installation of a large number of burners of the type producing low-axial-momentum, high-swirl flames on the furnace roof.

BRIEF DESCRIPTION OF THE INVENTION

Starting from this state of the art, the present invention aims to provide a burner limiting the heat-flux distribution heterogeneities in vertical planes parallel and perpendicular to the flame axis by spreading out the area for exchange between the flame and the plane of the bed of products to be treated.

In order for the result made possible by the present invention to be clearly understood, reference is made to FIG. 4 which shows the distribution of the heat flux of the flame of a burner produced according to the arrangements of the present invention. As in FIG. 2, the reference B denotes the burner, the reference P denotes the plane of the bed of products and the reference I denotes the image of the transmitted heat flux. It is clearly apparent from FIG. 4 that the burner according to the invention develops a flame spread out parallel to the bed of products and the flux of which is preferably in the plane of the major axis of symmetry of the tile, parallel to the plane of the products. Comparing FIG. 4 with FIG. 2, commented on above, it clearly shows the technical progress provided by the invention vis-a-vis the burners according to the prior art.

The result thus illustrated is achieved by a burner according to the present invention which is essentially characterized in that it is provided with a combustion tunnel having a broad shape, provided with oxidizer and fuel injection orifices, these being approximately parallel to the major axis of symmetry of the tile, the internal shape of the latter as well as the orientation of the fuel and oxidizer injection orifices being chosen so as to create a difference in the distribution of the combustion products and of the recycled flue gases, producing a spread-out flame which ensures homogeneous distribution of the heat flux.

According to the present invention, the said combustion tile has a rectangular or oval shape, or any combination of these two shapes.

According to another characteristic of the invention, the axes of the oxidizer and/or fuel injection orifices lie in planes approximately parallel to the plane of the products to be treated.

According to one non-limiting embodiment of the invention, the burner includes:

on the one hand, an oxidizer feed provided with injection channels emerging in the combustion tile via the injection orifices, the latter being distributed around the burner axis and having axes which lie in planes approximately parallel to the plane of the products to be treated, and on the other hand, a fuel feed located centrally and provided with injection channels which are distributed around the burner axis, their axes lying in planes approximately parallel to the plane of the products.

According to the invention, the injection channels emerge in the tile via the fuel injection orifices or, in the case in which the invention is applied to burners having separate fuel injection pipes, the fuel injection channels and orifices are located in the injection pipe.

These characteristics result in the gases having a low or zero swirl, thereby ensuring that the heat flux is distributed over a large area (or conversely), the flame at the exit of the combustion tile developing preferably in the plane of the major axis of symmetry of the tile, approximately parallel to the plane of the products.

According to another embodiment, the burner includes means for modulating the area over which the flame of the burner is distributed, it being possible for these means to be produced by delivering the oxidizer and/or the fuel in at least two separate groups.

The subject of the invention is also a furnace provided with burners having the characteristics defined above, especially a furnace for reheating iron and steel products. This furnace may include a radiating wall or exchange wall, located approximately parallel to the plane of the products to be treated, facing the flame spread plane of the burners. These burners are located so that the flame spread plane is approximately parallel to one of the walls of the furnace. According to the invention, the burners may be fitted into the side walls of the furnace, into at least one of its front walls, above and/or below the plane of the products to be treated.

Other features and advantages of the present invention will emerge from the description given below with reference to the appended drawings which illustrate embodiments of the invention, these being devoid of any limiting character.

BRIEF DESCRIPTION OF THE DRAWINGS

In the drawings:

FIGS. 5 and 6 illustrate a first embodiment of a burner according to the present invention. It may be seen that this burner has a combustion tile 10, of broad shape, which in the non-limiting embodiment illustrated by these figures is rectangular, of dimensions L and H and with its major axis of symmetry lying in the plane PS that lies approximately parallel to the plane P of the products 1 to be treated. Of course, this is merely one embodiment which has no limiting character, it being possible for the combustion tile 10 to be produced with any other broad shape, such as, for example, an oval shape or any combination of an oval shape and of a rectangular shape with an L/H ratio greater than 1.

DETAILED DESCRIPTION OF THE INVENTION

Figure 5:
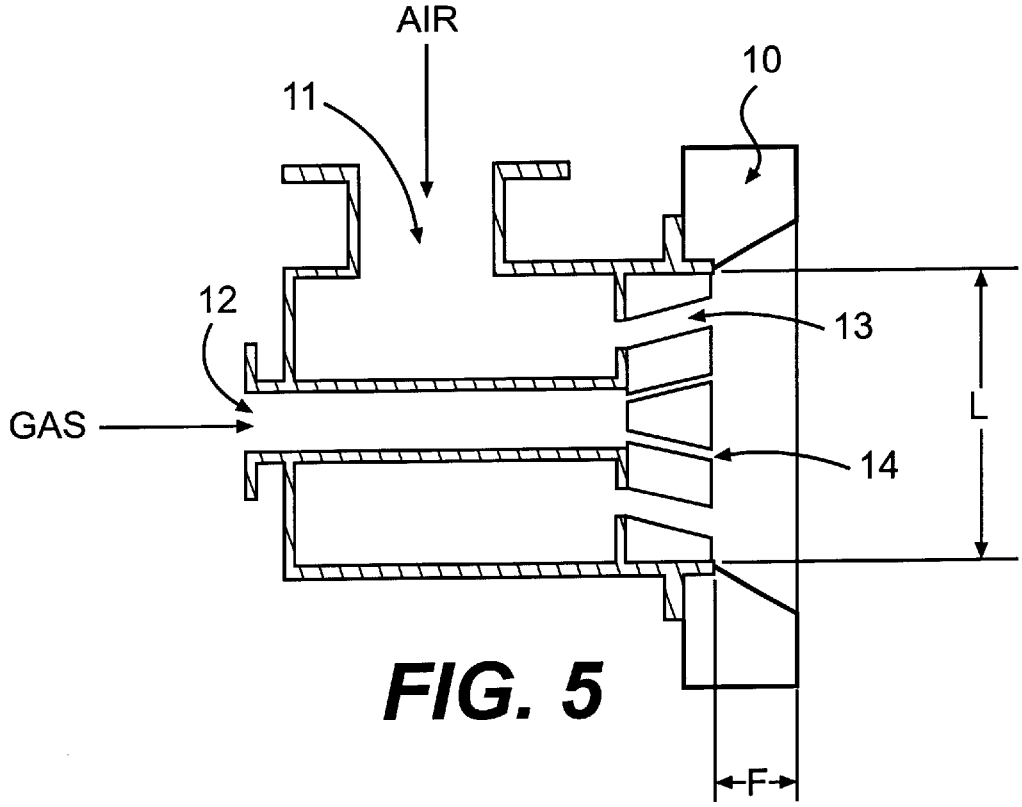
FIG. 5 is a schematic view of the burner according to a first embodiment of the invention, in cross section in a plane parallel to the planes P and PS in FIG. 6.

The walls of the combustion tunnel 10 may be flared out over the depth F, as illustrated by FIG. 5.

The supply of fuel, which in this non-limiting embodiment is gas, is connected to the burner at 12, this fuel being injected via orifices 14. The supply of oxidizer, which in this non-limiting embodiment is air, is connected to the burner at 11, the oxidizer being injected via orifices 13.

The fuel and oxidizer injection channels are distributed around the burner axis. Their axes lie in planes approximately parallel to the plane PS so as to ensure preferential distribution of each fluid, which causes the flame to spread out in a plane approximately parallel to the planes PS and P.

Figure 4:
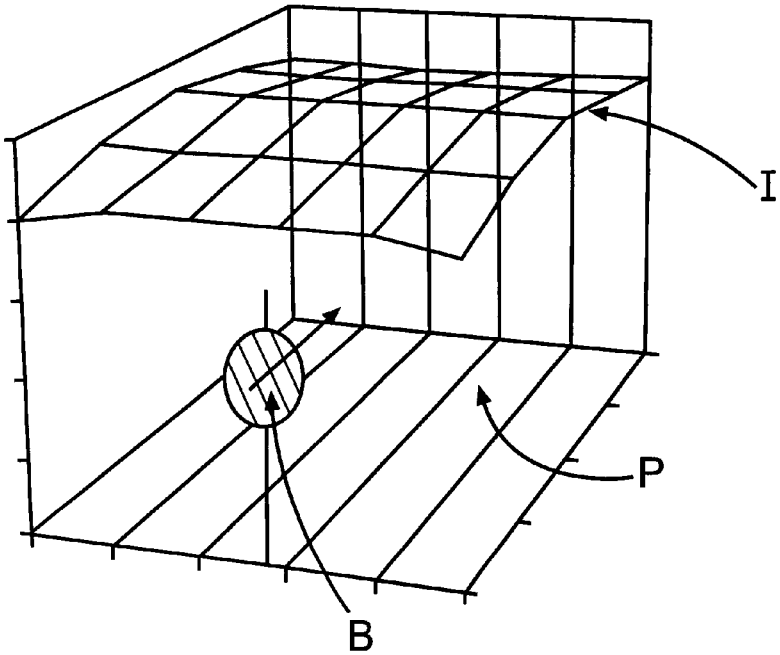
FIG. 4 shows the distribution of the heat flux of the flame of a burner according to the present invention.

The burner thus produces, at the exit of the tile 10, a spread-out flame with a homogeneous distribution of the heat flux in a plane approximately parallel to the plane PS. The heat-flux distribution obtained is in accordance with that shown in FIG. 4.

Figure 7:
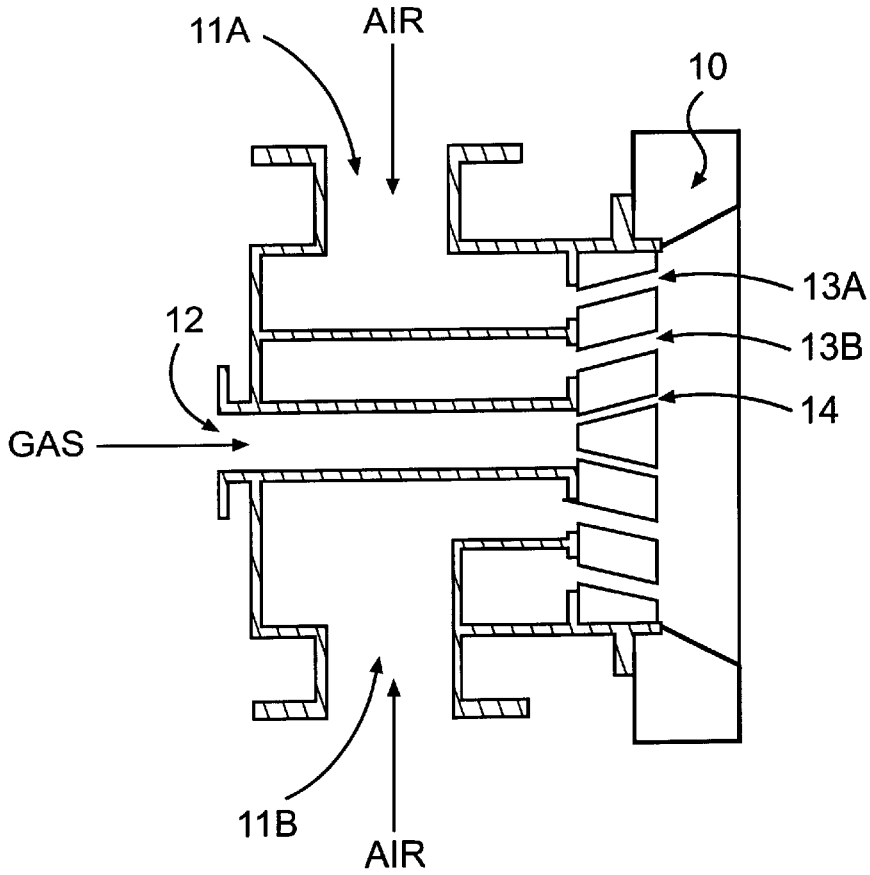
FIG. 7 is a view similar to FIG. 5, illustrating a second embodiment of the burner forming the subject of the present invention.

According to another characteristic of the present invention, the burner may be provided with devices for modulating the area over which the heat flux of the flame of this burner is distributed. One embodiment of such a device is illustrated by FIG. 7.

Figure 6:
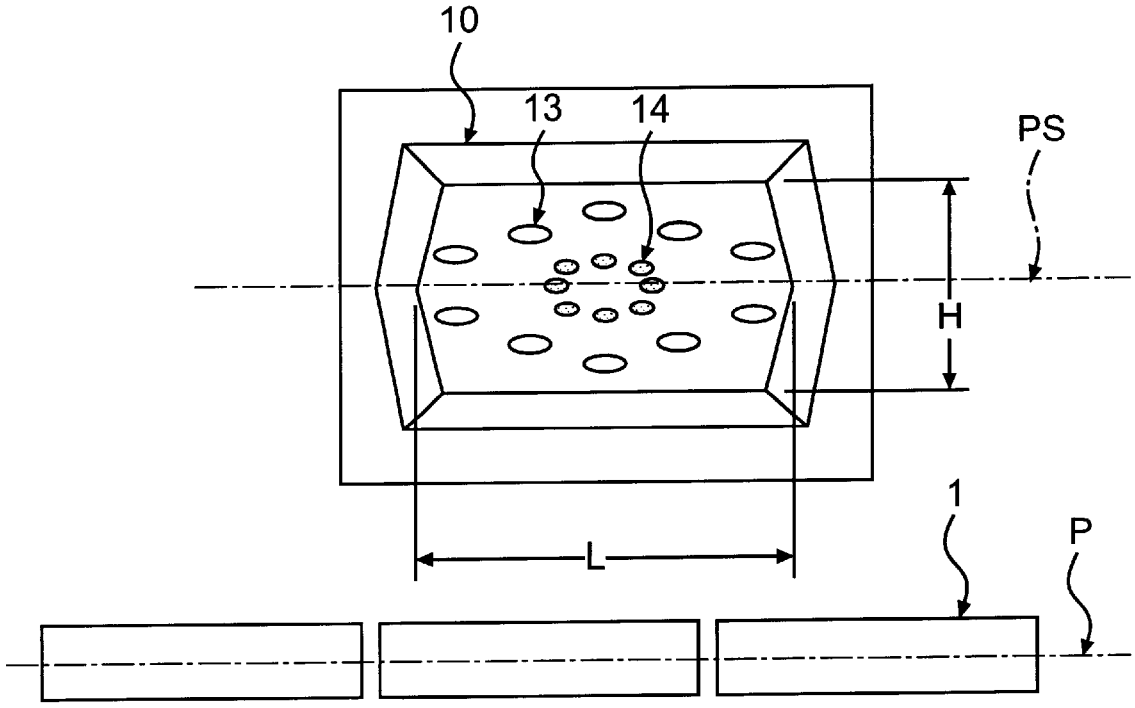
FIG. 6 is a view of this same burner, from inside the furnace, FIG. 6 being rotated 90° relative to FIG. 5.

This Figure shows the various component parts of the burner according to the invention as described above with reference to FIGS. 5 and 6. In this embodiment, which has no limiting character, the oxidizer is delivered in two separate groups 11A and 11B feeding respectively two groups of separate injection channels 13A and 13B, the axes of the injection channels 13A and 13B being approximately parallel to the plane PS. The two groups of channels may be inclined with respect to the burner axis in an identical or different manner.

Modulating the ratio of the flow rates and the pressures of the two streams of oxidizer passing through the two groups of injection channels 13A and 13B makes it possible to modulate the area over which the flame spreads out. Of course, the same arrangement may be adopted with regard to the fuel feed, it being possible for the latter also to be produced in separate groups so as to control and modulate the area over which the heat flux of the burner is distributed.

The burner forming the subject of the present invention and described above may be used in particular to equip a reheat furnace for iron and steel products, a soaking furnace or a heat-treatment furnace, it being understood that these examples of its application have no limiting character. The burners are located in these furnaces so that the plane in which their flames spread lies approximately parallel to one of the walls of the furnace so as to obtain a radiating wall approximately parallel to the plane of the products to be treated.

Figure 1:
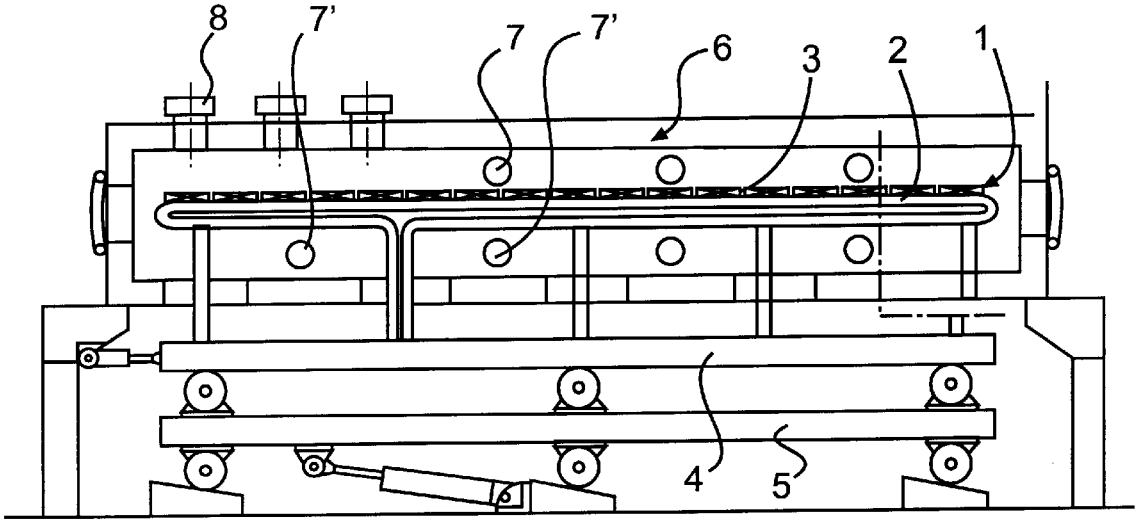
FIG. 1 PRIOR ART
FIG. 1, which was discussed above, shows, in side elevation and vertical cross section, an embodiment of a furnace to which the present invention may be applied.
Figure 2:
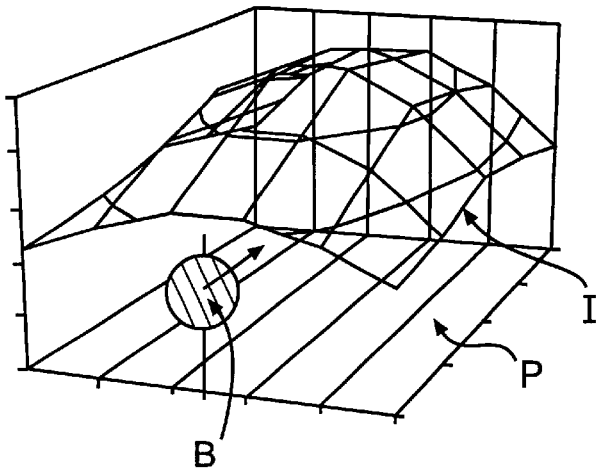
FIG. 2 PRIOR ART
FIG. 2 illustrates the distribution of the heat flux produced by currently known burners, of the type discussed above.
Figure 3:
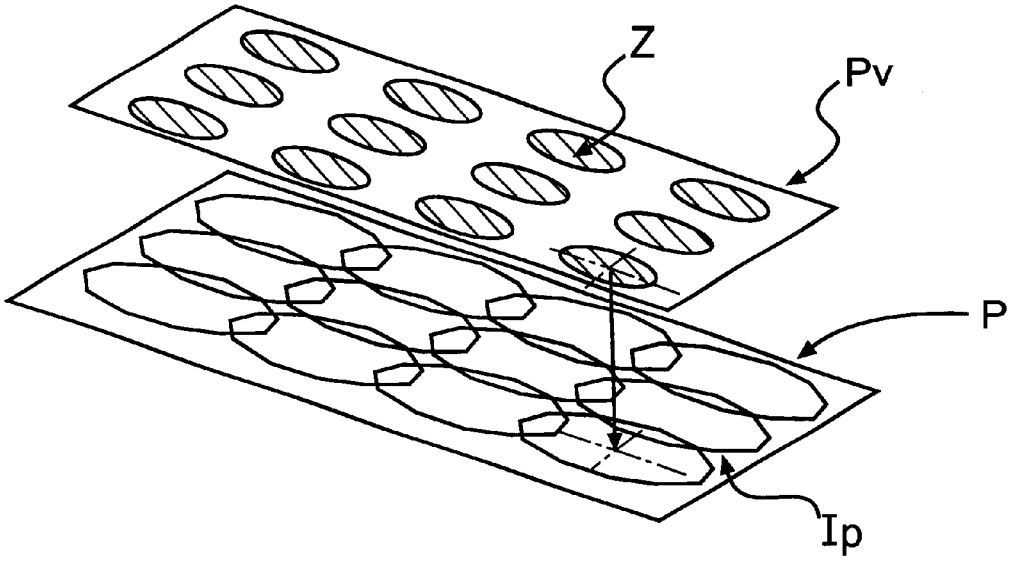
FIG. 3 PRIOR ART
FIG. 3, discussed above, is a diagram illustrating the distribution of the roof burners provided in the equalizing zones of the known furnace illustrated in FIG. 1.

The burners forming the subject of the present invention may be fitted into the side walls of a furnace, as shown in FIG. 1, above and/or below the plane P of the products, as illustrated at 7 and 7' in FIG. 1, so as to reheat the products homogeneously over their top and bottom faces.

Figure 8:
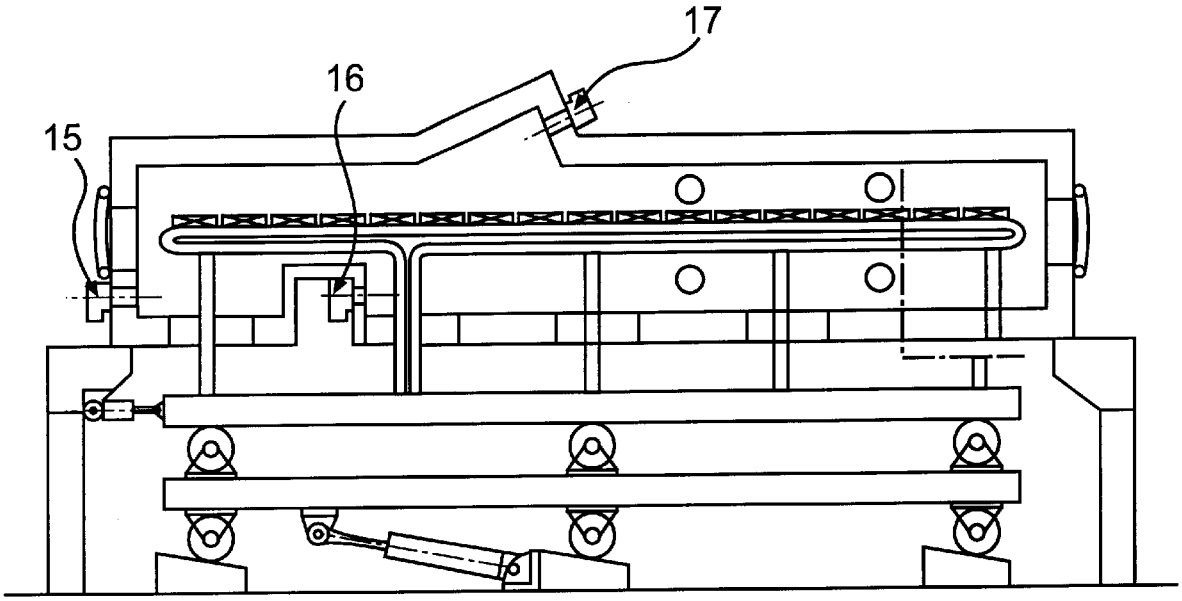
FIG. 8 illustrates, in side elevationn and vertical cross-section, a furnace in accordance with FIG. 1 fitted with burners.

The burners according to the invention may also be located on at least one of the front walls of the furnace, above and/or below the plane P of the products to be treated. FIG. 8 illustrates several known examples of burners fitted into the front wall in a reheat furnace of the type according to FIG. 1. The burners 15 may be fitted into the end walls of the furnace, above or below the plane P of the products, the burners 16 may be fitted at any point along the furnace, below the plane P of the products, and the burners 17 may be fitted at any point along the furnace, above the plane P of the products.

As will have been understood, the present invention provides a burner with a spread-out flame making it possible to limit the temperature gradient at the surface of the products, which are positioned in the furnace provided with such burners, and, consequently, throughout the products, with an identical amount of heat transmitted. Reducing the heterogeneities in the distribution of the heat flux in vertical planes parallel and perpendicular to the flame axis, obtained by spreading the area, of exchange between the flame and the plane of the bed of products, makes it possible in particular:

- to reduce the duration of the phase for equalizing the temperatures of the products, and therefore the length of that zone of reheat furnaces in which this temperature equalizing takes place;
- to limit the risks of localized overheating of the product, because of the absence of a hot zone or hot spot in the flame. This characteristic allows the final metallurgical state of the treated product to be improved;
- to distribute the combustion over a larger area, thereby allowing better control of the mixing of these fluids and therefore the composition of the furnace atmosphere and of the flue gases. This reduces the emissions of pollutants generated by the combustion and reduces the formation of oxides on the surface of the reheated products;
- to reduce the height of the heating chamber of the furnace by reducing the extent of the flame perpendicular to the plane of the products or by reducing the number of burners;
- to replace a large number of burners fitted into the roof of the furnace with a smaller number of burners fitted into the walls of the furnace. The fuel and oxidizer delivery circuit is shorter and produced for a lower cost.

The abovementioned advantages relate to the top and bottom faces of the product, the burner forming the subject of the present invention possibly being fitted in planes lying either above or below the products, as was seen above with reference to FIG. 1.

Of course, it remains to be stated that the present invention is not limited to the embodiments described and/or illustrated here but that it encompasses any variant thereof.

What is claimed is:

1. Fluid-fuel burner of the type producing a flame with axial development, which comprises a combustion tile having an elongated shape, and provided with oxidizer injection orifices and fuel injection orifices, the axes of symmetry of the oxidizer injection and fuel injection orifices being approximately parallel to the major axis of symmetry of the tile, the internal shape of the tile as well as the orientation of the fuel and oxidizer injection orifices being chosen so as to create a difference in the distribution of the combustion products and of recycled flue gases, producing a spread-out flame which ensures homogeneous distribution of heat flux.

2. Burner according to claim 1, wherein said combustion tile has a rectangular shape.

3. Burner according to claim 1, wherein said combustion tile has an oval shape.

4. Burner according to claim 1, wherein the shape of the combustion tile has a combination of rectangular and oval shaped sections.

5. Burner according to claim 1, wherein the axes of symmetry of the oxidizer and/or fuel injection orifices lie in planes approximately parallel to the plane of products being treated.

6. Burner according to claim 1, further including an oxidizer feed provided with injection channels emerging in the tile via the injection orifices, the orifices being distributed around a burner axis and having axes of symmetry which lie in planes approximately parallel to the plane of products being treated.

7. Burner according to claim 1, further including a fuel feed located in a central portion of the tile and provided with injection channels which are distributed around the burner axis, the channel axes lying in planes approximately parallel to the plane of the products being treated.

8. Burner according to claim 1 further comprising fuel injection channels which emerge in the combustion tile via the injection orifices.

9. Burner according to claim 8, further including a separate fuel injection pipe, the fuel injection channels and the fuel injection orifices being located in the injection pipe.

10. Burner according to claim 1, wherein at least one of the oxidizer and the fuel are delivered in at least two separate groups.

11. Burner according to claim 10, wherein the oxidizer is delivered in two separate groups feeding respectively two groups of injection channels, the axes of the injection channels being approximately parallel to the plane of products being treated.

12. Burner according to claim 11, wherein the two groups of injection channels are inclined with respect to the burner axis.

13. Burner according to claim 1, wherein the walls of the combustion tile are flared out over its depth.

14. Burner according to claim 1, together with a furnace wall located approximately parallel to the plane of products to be treated, facing a flame spread plane of the burner;

wherein the burner operates within a furnace for reheating iron and steel products.

15. Burner according to claim 14, wherein the burner is located so that the flame spread plane is approximately parallel to a wall of the furnace.

16. Burner according to claim 14, wherein the burner is fitted into side walls of the furnace, in spaced relation to the plane of products being treated.

17. Burner according to claim 14, further wherein the burners are located on at least one front wall of the furnace, in spaced relation to the plane of products being treated.

* * * * *